US006460322B1

(12) United States Patent
Sato et al.

(10) Patent No.: US 6,460,322 B1
(45) Date of Patent: Oct. 8, 2002

(54) CORED YARN, AND METHOD AND APPARATUS FOR PRODUCING THE SAME

(75) Inventors: Koichi Sato, Sagae; Mamoru Tai, Nishikawa-machi, both of (JP)

(73) Assignee: Hirashio Co., Ltd., Yamagata-ken (JP)

( * ) Notice: Subject to any disclaimer, the term of this patent is extended or adjusted under 35 U.S.C. 154(b) by 58 days.

(21) Appl. No.: 09/639,659

(22) Filed: Aug. 16, 2000

(30) Foreign Application Priority Data

Sep. 22, 1999 (JP) ..... 11-267962
Oct. 13, 1999 (JP) ..... 11-291000

(51) Int. Cl.[7] ..... D02G 3/36
(52) U.S. Cl. ..... 57/225
(58) Field of Search ..... 57/3, 3.5, 4, 5, 57/6, 10, 11, 12, 13, 14, 28, 210, 224, 225, 226, 227, 228

(56) References Cited

U.S. PATENT DOCUMENTS 6,318,060 B1 * 11/2001 Dinkelmann et al. ..... 57/3

FOREIGN PATENT DOCUMENTS

| | | | |
|---|---|---|---|
| DE | 195 01 163 | | 4/1996 |
| EP | 0 017 943 | | 10/1980 |
| LU | 48 578 | | 11/1965 |
| WO | WO-95/02085 | * | 1/1995 |
| WO | WO 95/02085 | | 1/1995 |
| WO | WO 98/32904 | | 7/1998 |
| WO | WO-98/32904 | * | 7/1998 |
| WO | WO-99/51801 | * | 10/1999 |

* cited by examiner

*Primary Examiner*—Danny Worrell
*Assistant Examiner*—Shaun R Hurley
(74) *Attorney, Agent, or Firm*—McDermott, Will & Emery

(57) ABSTRACT

Rovings 30A and 30B as drafted are, under a parallel condition, passed through a collector 16, twisted and wounded from front rollers 12-1 and 12-2. A core yarn 34 is, via a guide member 40 as a snail wire, introduced into rovings 30A and 30B from the rear side of the front rollers. Since the guide member 40 is fixedly connected to the collector 16, the guide member 40 can follow with the lateral displacement of the collector 16, so that a central feed of the core yarn 34 to the rovings 30A and 30B is maintained, thereby always keeping a condition that the core 34 is fully covered by the outer fibers.

3 Claims, 6 Drawing Sheets

PRESENT INVENTION

PRIOR ART

OUTER FIBER CORE

CORED YARN, AND METHOD AND APPARATUS FOR PRODUCING THE SAME

BACKGROUND OF THE INVENTION

1. Field of the Invention

The present invention relates to a cored yarn having, as inner fibers (core), stretchable filament yarns such as spandex (polyurethane elastic yarns) and, also, relates to a method and apparatus for producing such a cored yarn.

2. Description of Related Art

Various types of cored yarns, having, as a core, stretchable filament yarns such as spandex and having, as an outer part, natural fibers such as wool or cotton (staple fibers), have here-to-fore been proposed. Such a type of core yarn is intended for imparting to the yarn a stretchability of the spandex as well as a soft touch of the natural fibers and is mainly targeted to be used for a knit wear. In order to produce such cored yarn, a fine spinning of wool or cotton is carried out in such a manner that the core is mixed with a roving from a rear side of front rollers. The stretchable filaments mixed with the roving under drafting operation from the front rollers is subjected to a twisting operation together with the drafted outer fibers constructed by wool or cotton and is subjected to a winding operation, resulting in a formation of a cop.

In the conventional cored yarn have, as a core, spandex, a use of wool as outer fibers may case a soft touch to be easily lost due to a shrinkage as occurred by a washing. Thus, a selling of the product must necessarily be made together with a warning for prohibition of a washing, which may likely cause the products not to be accepted in the market.

Furthermore, in the prior art cored yarn, a condition, that a core (inner fibers) is completely covered by the outer fibers, is not always maintained. Namely, any control of the core is not done, resulting in an exposure of the core yarn to the outer layer at positions along the length of the yarn. In such a situation, the yarns provide locally differently sparkled portions, which makes a knitted fabric to be defective one and which also makes a dyed fabric to be defective one since the sparkled portions are colored differently.

SUMMARY OF THE INVENTION

An object of the present invention is for overcoming the above mentioned difficulties and is for providing a construction of a cored yarn of an increased washability, while being capable of maintaining a condition that the core is always fully covered by the outer layer.

According to the first invention, a cored yarn is provided, which comprises inner fibers formed by stretchable filament yarns and outer fibers formed by non-shrink treated wool.

By the filament yarns as a core and the wool as the outer layer according to the present invention, a knitted fabric having both of stretchability as well as soft touch is obtained, and the non-shrink treatment of the wool allows an washing to be practiced, thereby obtaining a garment of an enhanced handleability.

According to the second invention, a cored yarn is provided, which comprises inner fibers formed by stretchable filament yarns and outer fibers formed by short fibers, said outer fibers comprising two parts which substantially separately twisted, said stretchable filament yarns being located intermediate between said separately twisted parts constructing said outer fibers which are twisted. The outer fibers may be constructed by wool, which is preferably subjected to non-shrink treatment, while the inner fibers may be constructed by a spandex of a heat set type. Furthermore, the spandex may be the one which, at its outer layer, lapped by synthetic fiber filaments.

According to the third invention, a cored yarn is provided, which is produced by drafting, in parallel, a plurality of rovings and twisting them together, while combining, from a rear side of front rollers, a stretchable filament yarn to said drafted rovings, while guiding said stretchable filament yarn so that the latter is maintained centrally between said drafted rovings, so that the stretchable filament yarn is positioned centrally, around which portions of the yarn from the rovings are twisted.

In the third invention, in order to produce the cored yarn, said two rovings, which become the outer fibers short fibers (staple fibers), are simultaneously fed to the drafting part, while the stretchable filament yarns which become the core yarn are introduced from the rear side of the front roller in such a manner that the filaments yarns are guided to the intermediate position between the two rovings which are under drafting operation. As a result, the two rovings emerged from the front roller are, first, subjected to a separate twisting for causing their fibers to be twisted each other and are, then, integrated to a single yarn in such a manner that the stretchable filament yarns as the core are located intermediate between the integrated portions of (outer fibers) which are twisted. As a result, a brightly colored yarn of reduced fluff can be produced and a condition is always maintained in such a manner that the stretchable filament yarns as the core are fully covered by the wool as the outer layer. As a result, the core fibers are prevented from being emerged outwardly, so that an occurrence of defects during knitting process or dyeing process is less likely. Finally, the wool constructing the outer layer is preferably subjected to the non-shrink treatment, and the inner fibers may be a spandex of a heat set type.

According to the fourth invention, a method is provided for producing a cored yarn, said method comprising the steps of:

- providing drafting device having back rollers and front rollers between which a drafting zone is created;
- feeding a plurality of rovings, under a parallel condition, to said back rollers for causing the rovings to be subjected to a drafting operation at the drafting zone;
- feeding, from the front rollers, filament fibers so that the filament fibers are combined with the drafted rovings;
- guiding the filament fibers so that the feeding of the filament fibers are substantially always done at a central position between the plurality of the rovings, and;
- twisting and taking-up the drafted roving together with the filament fibers for obtaining a cored yarn wherein the filament fibers as a core is covered by the twisted rovings as outer fibers.

In the operation of the fourth invention, a plurality of rovings are fed, in parallel, to the draft part, and a guiding of the filament fibers as the core is done in such a manner that the filament fibers are always fed to the central position between the rovings which are fed in parallel. As a result, an advantage is obtained that a condition is always and steadily obtained that the filament fibers as the core is fully covered at the center of the outer fibers. As a result, the filament fibers as the core is prevented from being displaced to the outer layer and, in a subsequent process, an occurrence of defects at a knitting or weaving or dyeing speck is substantially completely prevented.

According to the fifth invention, system for producing a cored yarn, said system comprising:

a drafting unit comprising front rollers and back rollers, between which a drafting zone is created for executing a drafting operation of rovings as outer fibers;

a collector arranged at the inlet of the front rollers for collecting the rovings and guiding the them to the front rollers, the collector having a width which allows the rovings to be fed to the front roller while keeping substantially separated condition;

a feeder of the filament fibers to the front rollers, the filament fibers being combined with the drafted rovings;

a guide of the filament fibers to the front roller, said guide being harmonized with the lateral movement of the rovings at the front roller in such a manner that the filament fibers is always fed to the rovings at a central position between the rovings, and;

a spindle by which the drafted rovigns are twisted and taken-up together with the filament fibers, thereby obtaining a cored yarn wherein the filament fibers as a core is covered by the twisted rovings as outer fibers.

In the operation of the fifth invention, a plurality of rovings during the drafting is maintained in their paralleled condition at the collector and are twisted and taken up from the front rollers. The guide member for guiding the filament fibers is mounted to the collector. As a result, even in a movement (displacement in the lateral direction) of the collector, the guide member is always integrally moved with respect to the collector, so that a positional relation-ship of the filament fibers between intermediate between the rovings is always maintained. As a result, a condition is constantly and steadily obtained that the filament yarns as the core are completely and centrally covered by the outer layer fibers. In the fifth invention, a very simplified construction, that the guide member is fixedly connected to the collector, can solve the problem and, therefore, is advantage since the aim can be realized at a highly reduced cost.

BRIEF DESCRIPTION OF ATTACHED DRAWINGS

Figure 7:
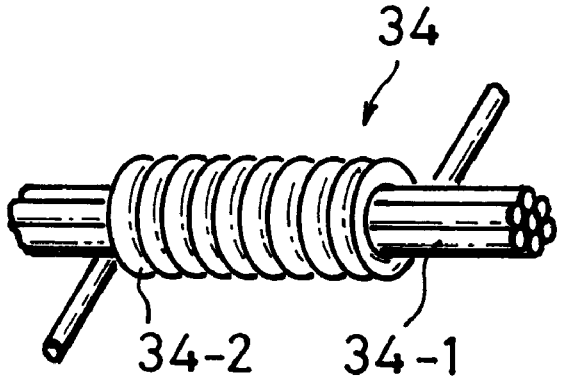

FIG. 7 schematically illustrates a construction of the core used in the cored yarn according to the present invention.

DETAILED EXPLANATION OF PREFERRED EMBODIMENT

Now, an embodiment of the present invention will be explained, wherein, in a cored yarn according to the present invention, a core (inner fibers) can be a spandex (polyurethane elastic yarn) subjected to a heat setting, and outer fibers can be wool fibers such as merino wool, cashmere, camel, alpaca or angora. Preferably, the spandex is of a type which is subjected to a heat set treatment for reducing stretchability. The heat set treatment is desirably of a so-called high heat set type, where a heat treatment in a liquid is done in a temperature range of 100 to 130° C. for a duration of 60 minutes, so that a value of a set ratio in a range between 60 to 80% is obtained, resulting in an increased dimensional stability as to fabric width as well fabric density as obtained after execution of a knitting operation. In this specification, the set ratio implies a ratio, to a the sample length of a spandex yarn, of an elongation under a relaxed condition after a heat treatment for a predetermined time under 100% stretching of the yarn (twice length stretching of the sample). A value of set ratio of 50%, for example, implies that, when by an elongation of a spandex yarn of a length of 10 cm to a length 20 cm of under a loading under a heat treated condition for a predetermined time, a sample length is 15 cm after the loading is cancelled.

As for the spandex, the one is desirable, that has an outer layer which is constructed by lapped nylon filaments. The nylon has an increased dyeability, which causes an occurrence in the dying defects to be less likely, resulting in an increased acceptability in the market of a fabric which is obtained by knitting the core yarn.

As for the wool fibers, the ones subjected to the non-shrink treatment is desirable. As well known, in such a non-shrinkage treatment, the wool is subjected to an alkaline treatment for removing scales. In accordance with production sites of wool, conditions for the non-shrink treatment are respectively determined. According to the present invention, non-shrink treatment wool from the various production sites can be used.

The use of the wool as the outer layers allows a soft touch to be obtained and the non-shrink treatment of the wool allows the washability to be enhanced and the soft touch to be, advantageously, maintained.

As for the outer fibers, in place of the wool as explained above, synthetic cut fibers (staple fibers) such as acrylic, rayon, nylon, polyester or acetate fibers can be used and natural fibers such as jute (linen, ramie or hemp) or cotton or silk can be used.

According to the present invention, the cored yarn is constructed by inner fibers constructed by the stretchable filament yarns, preferably high set type spandex and outer fibers constructed by short fibers, preferably non-shrink treated wool and the stretchable filament yarns are twisted centrally between the rovings as the outer fibers fed separately. In this case, during the manufacture of the cored yarn, the short fibers (staple fibers) as the outer fibers are constructed by two rovings which are simultaneously fed to the drafting part, where the rovings are subjected to the drafting operation. The two rovings from the front rollers are, first, twisted separately and, finally, formed to a single yarn, which is wound to a shape of a cop shape. In this case, the rovings coming out from the front rollers, which although are located very close with each other, subjected to a twisting operation under individually separated condition, which causes the fibers to be mutually engaged, thereby obtaining a taken-up yarn of a reduced fuzz as well as of an increased smoothness. Furthermore, the guiding operation of the stretchable filament yarns as the core from the rear side of the front rollers is such that the stretchable filament yarns are always fed to the two rovings at the central position. In order to cause the stretchable filaments to be guided, a guide of the shape of the so-called snail wire are fixedly connected to the collector. As a result, the feed of the stretchable filaments as the core are always done at the position intermediate between two drafted rovings. As a result, at the outlet of the front rollers, the stretchable filaments (core) are, at location where the separately twisted rovings are combined, twisted between the parts constructed by the separately twisted rovings. As a result, the core is always located centrally of the short fibers (staple fibers) as the outer fibers. In other words, the core can always maintain a condition that it is fully covered by the outer fibers, which prevents the core fibers from being emerged to the outer layer, which otherwise causes a defect to be generated at a knitting process, since the outwardly emerged core fibers are sparkled differently and which otherwise causes a defect to be generated at a dying process since the outwardly emerged core fibers are dyed differently from the wool fibers. Advantageously, the core is a spandex, about which synthetic fibers of an increased dyeability such as nylon are rapped, which makes an occurrence of an defect to be less likely during the execution of the dying process.

Figure 1:
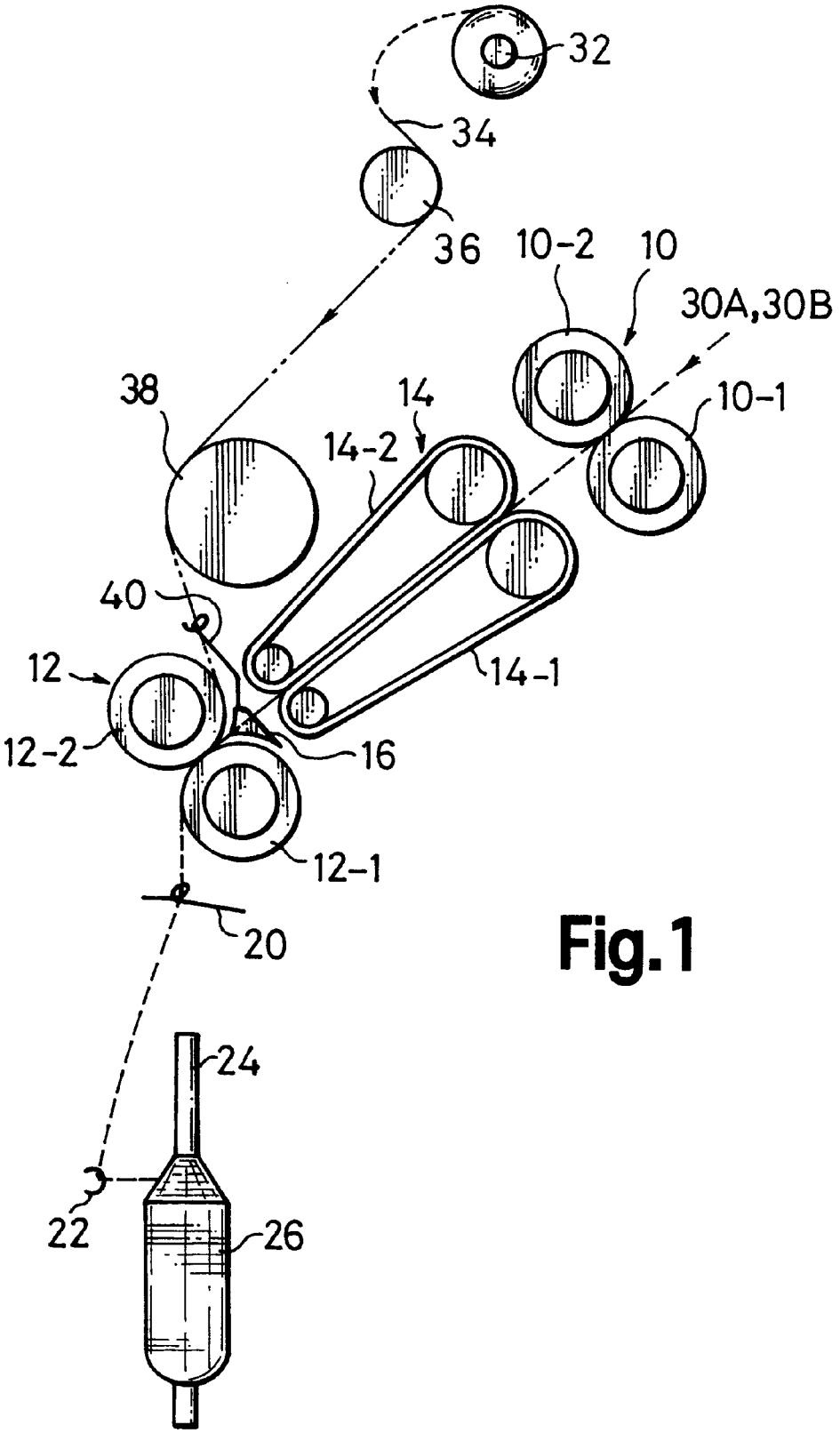
FIG. 1 is a schematic view illustrating a side view of a device for fine spinning according to the present invention.

Now, a construction of a worsted fine spinning frame which is used for an execution of the present invention will be explained. In FIG. 1, the fine spinning frame includes a drafting part which is provided with a back roller pair 10, a front roller pair 12, and an apron pair 14. The back roller pair 10 is constructed by a bottom roller 10-1 and a top roller 10-2, the front roller pair 12 is constructed by a bottom roller 12-1 and a top roller 12-2, and the apron pair 14 is constructed by a bottom apron 14-1 and a top apron 14-2. Arranged adjacent to the front bottom roller 12-1 is a collector 16, which collector 16 is adapted to function with a guide for directing the roving under the drafting operation toward the front roller pair 12. In a well known manner, the collector 16 is mounted to a wire shaped holder 18 (see FIG. 3) which is extended toward the front roller pair 12 from an end of a cradle (not shown) which functions as a supporting frame of the bottom apron 14-1.

The ratio (draft ratio) of rotational speed of the front roller pair 12 with respect to the rotational speed of the back roller pair 10 is a predetermined value, which causes a drafting to be imparted to the roving directed to the front roller pair 12, which causes the roving to be thinner, which is issued from the front roller pair 12 and is, via the snail wire 20 and the traveler 22, wound to the paper tube 24 on the spindle while being subjected to the twisting, thereby obtaining a shape of the cop 26.

Figure 2:
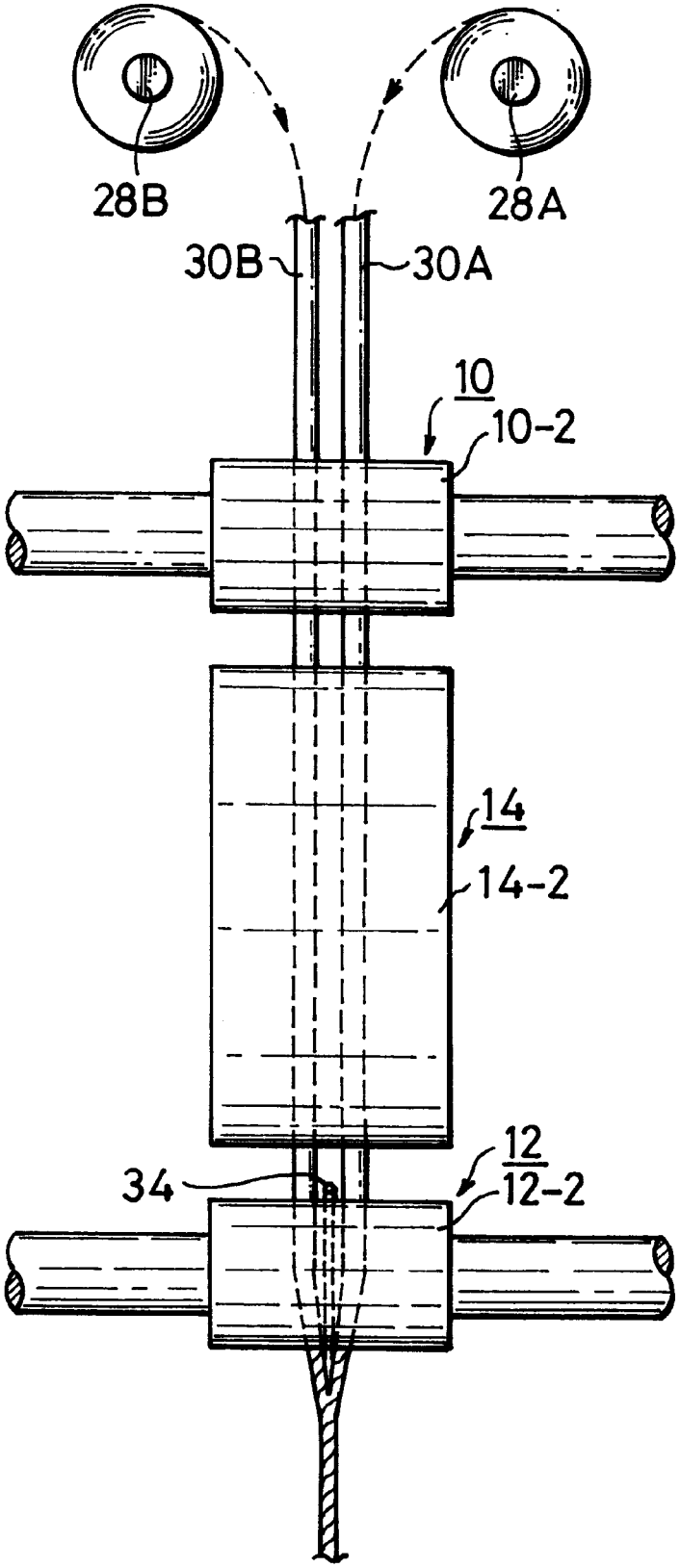
FIG. 2 is a schematic view illustrating a plan view of the device for fine spinning according to the present invention.

A not shown creel is provided, on which bobbins are provided. As shown in FIG. 2, for each of the spindles, two roving bobbins 28A and 28B are provided. The rovings 30A and 30B twisted slightly and taken out of the bobbins 28A and 28B at each spindle are fed, under a parallel condition, to the drafting apparatus. As a result, between the back roller pair 10 and the front roller pair 12, the rovings, which are kept in parallel, are subjected to a drafting operation under a predetermined drafting ratio. During the drafting operation, the rovings 30A and 30B are nipped vertically by the apron pair 14, which allows floating fibers to be controlled, thereby obtaining an even drafting operation. As a result, the rovings 30A and 30B are basically maintained under a parallel condition on the guiding groove 16-1 of the collector (FIG. 3) and are fed to the front roller pair 12. In other words, the collector 16 (FIG. 3) must necessarily be provided with a width which is large enough to cause the rovings 30A and 30B to be fed in parallel under separated condition.

The rovings 30A and 30B issued from the front roller pair 12 are, first, subjected to a separate twisting due to the rotating movement of the spindle, are, then, gradually converged and are, finally, composed to a single yarn. Such a system, wherein, for each spindle, two rovings are fed under a parallel condition, which are, after execution of drafting followed by twisting, combined to a single yarn, is based on the patent owned by the commonwealth Scientific Industrial Research Organization (CSIRO) in Australia and is called as a CSIROSPUN. This system is advantageous over a conventional system where a single yarn is Subjected to a drafting in that, under the same yarn count as well as a twisting number an increased anti-abrading performance as well as a reduced occurrence of fluff are obtained.

According to the present invention, the CSIROSPUN system is improved in that the introduction of the synthetic stretchable filament yarns (polyurethane elastic fibers (so-called spandex yarn)) as the core is done at the center between the rovings 30A and 30B which are in parallel condition and a control of the feed of the core is done in such a manner that the feed of the core to the central position between the rovings 30A and 30B is maintained, thereby always keeping the central position of the core within the outer fibers.

Now, a feed of the core yarn will be explained. The bobbin 32 (FIG. 1) is for winding thereon the synthetic stretchable filament yarns such as the spandex as the core. The core yarn 34 taken out from the bobbin 32 is, via a feed roller 36, a guide roller 38 and a guide member 40 as a shape of a snail wire, is mixed with the rovings at the front roller pair 12. The core yarn 34 is under a stretched condition by a drafting of a ratio of a value such as 1.5, so that the core yarn 34 of a predetermined tension is combined to the rovings 30A and 30B.

Figure 3:
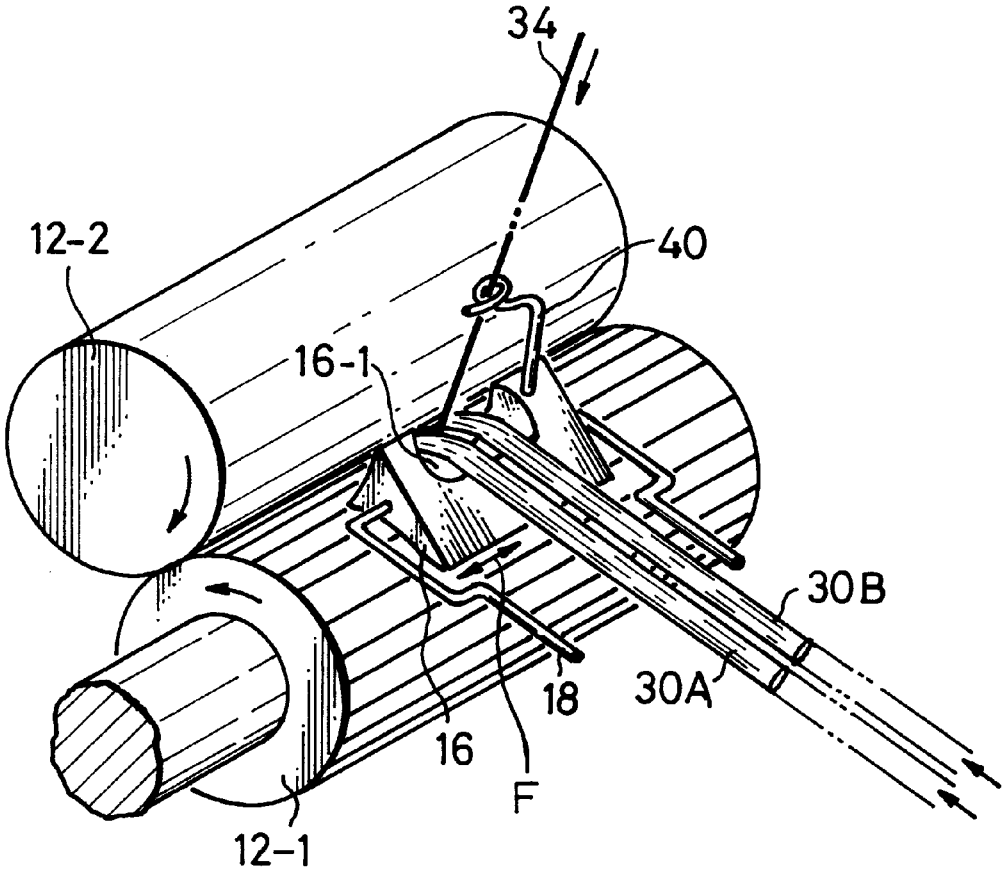
FIG. 3 is a schematic perspective view of a fine spinning frame according to the present invention viewed from the rear side of front rollers in a drafting part.

As shown in FIG. 3, the guide member 40 is mounted to the collector. As to the guide member 40 refer also to FIG. 1. Namely, the guide member 40 is, as shown, of a shape of a snail wire, which has a bottom end inserted to a bore formed in the collector and is fixed by a measure such as adhesive.

Figure 4:
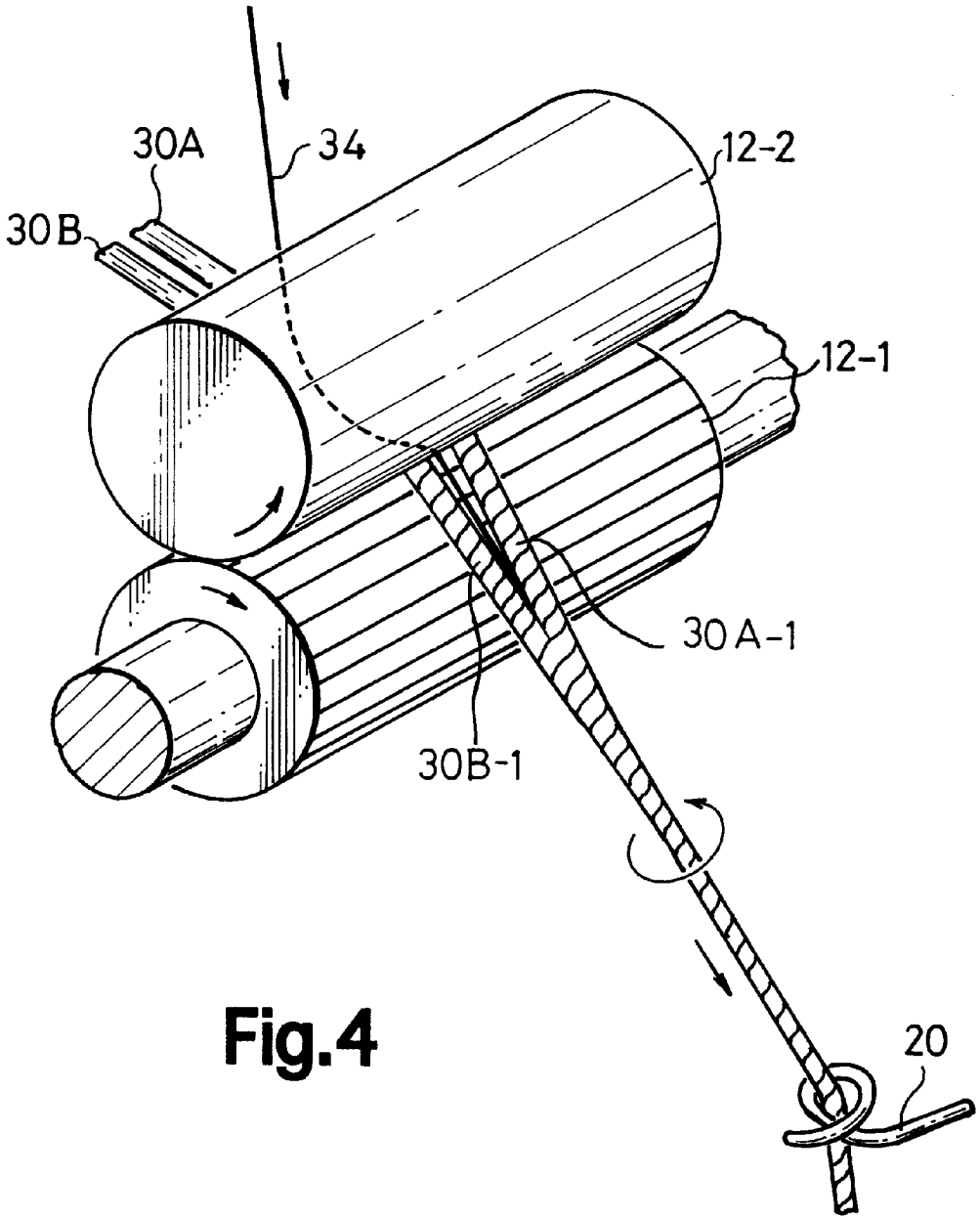
FIG. 4 is a schematic perspective view of a fine spinning frame according to the present invention viewed from the front side of the front rollers in the drafting part.

During the fine spinning operation, the rovings 30A and 30B are subjected to a drafting operation at the drafting zone, which is located between the back roller pair 10 and front roller pair 12, while being guided by the groove 16-1 of the collector 16, are issued out of the front roller pair as shown by 30A-1 and 30B-1 in FIG. 4, and are wound to a paper bobbin while being subjected to a twisting. The rovings 30A-1 and 30B-1 issued from the front rollers are, first, twisted separately, are, then, gradually laterally displaced and are, finally, mutually twisted, thereby combined integrally, while the core yarn 34 introduced from the rear side of the front rollers are twisted between the rovings.

Figure 5A:
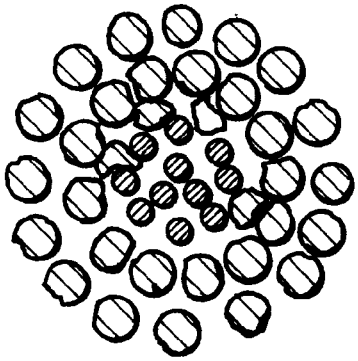
FIG. 5A is a schematic cross sectional view of a cored yarn according to the present invention.
Figure 5B:
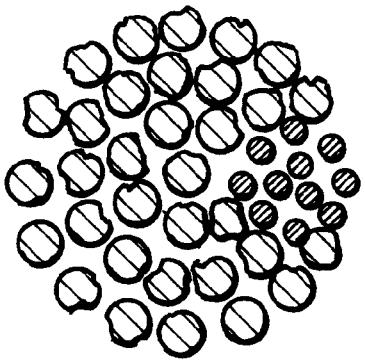
FIG. 5B is a schematic cross sectional view of a cored yarn in the prior art.

As shown in FIG. 3, the collector 16 is merely freely inserted to the end of the wire shaped holder 18 which extends from the cradle (not shown) for the lower side apron 14-1 (FIG. 1). As a result, during the execution of the yarn production, the collector 16 is constantly subjected to the oscillation caused by a vibration of the machine as well as a vibration of the yarn, so that the lateral position of the collector 16 is not fixed and is constantly displaced laterally. Such a lateral displacement of the collector 16 is illustrated by an arrow F in FIG. 3. In view of this, if the core yarn 34 from the guide roller mounted to the machine frame are merely combined with the rovings 30A and 30B without use of the guide 40, the position of the rovings 30A and 30B where the core 34 is combined will be constantly laterally displaced due to the fact that the lateral position of the guide roller 38 is fixed, on one hand and, on the other hand, the collector 16 is constantly, delicately laterally displaced. In other words, the core yarn 34 can not always supplied to the central position between the rovings 30A and 30B, so that the position of the feed of the core yarn 34 to the rovings 30A and 30B is displaced from the central position, which causes a situation to be frequently arisen that the core yarn is located at the end position in the cross section of the yarn after the twisting and winding. FIG. 5B illustrates, in the prior art, the distribution of the core fibers in the yarn after execution of the twisting and winding, wherein the core fibers are moved to the outermost layer. At the location where the core is moved to the outer layer, the yarn produce a sparkled appearance, which causes surface defects to be generated after the execution of the weaving or dyeing.

Contrary to this, according to the present invention, the guide member 40 as the snail wire which effects the final guiding of the core 34 is directly fixed to the collector 16. Thus, even in a situation that the collector 16 is moved laterally as shown by an arrow F (FIG. 3), a movement of the guide member 40, which is in synchronous with the movement of the collector 16 as shown by the arrow F, is obtained. As a result, the core 34 is always combined with the rovings 30A and 30B guided by the collector at a central position between the rovings 30A and 30B irrespective of the lateral movement of the collector 16. As a result, in FIG. 5A, the core always occupies the central position in the cross section of the yarn. Thus, at the outlet side, the core is always located at the center of the roving issued from the front rollers, and the core is combined at the location where the rovings are integrally combined.

Figure 6:
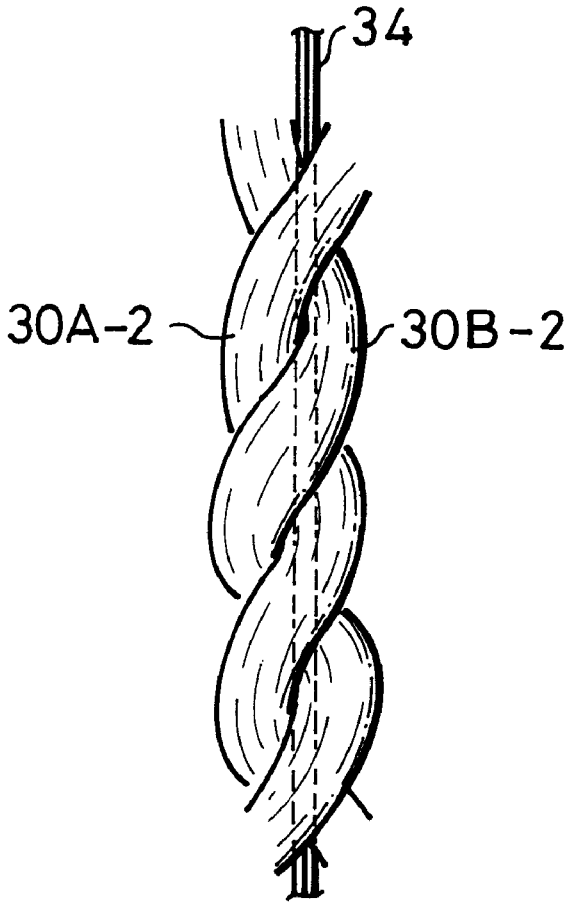
FIG. 6 is a view illustrating an outer appearance of the cored yarn according to the present invention.

FIG. 6 illustrates the completed state of the cored yarn. Namely, the rovings 30A-1 and 30B-1 issued from the front roller pair 12 are, first, subjected to the separate twisting, and, finally, in the state of the completed yarn, the portions 30A-2 and 30B-2 from the portions 30A-1 and 30B-1, respectively are mutually twisted as shown in FIG. 6. Furthermore, the core yarn 34 is located always at the central position between the yarn portions 30A-2 and 30B-2 which are twisted. As a result, the core 34 is located at the core (center) of the outer fibers (worsted wool yarn), and is prevented from being outwardly exposed, thereby preventing defect from being generated in a weaving or knitting process. As a result, a production of a cored yarn which is widely received in a market becomes possible.

Furthermore, due to a provision of the yarn structure of the respective yarn portions 30A-2 and 30B-2 twisted with each other while interposing the core yarn 34 therebetween, advantages are obtained that a fluffing is reduced and a brightness of the yarn is increased.

EXAMPLE 1

As the outer fibers anti-shrink treated wool was used. As the anti-shrink treated wool, anti-shrink treated tops which were produced by GH MICHAEL Co. in Australia were used. These tops were the ones which have an average fiber length of 65 mm.

These anti-shrink treated tops were passed 6 times by an intersecting gill box, thereby producing rovings.

Spandex yarns as the core were the high set type produced by Tory Du-Pont Co. in Japan (type T178C), which has a set ratio of a value in a range between 60 to 80% under a liquid state heat treatment of a temperature in a range between 100 to 120° C. Furthermore, the spandex yarn was the one which has total filament number of 36 and of a thickness of 18 denier and is of a covered spandex yarn having an outer surface covered by nylon filaments (30 denier thickness). Namely, as shown in FIG. 7. the core 34 has spandex filaments 34-1 which are, at their outer surface, rapped by nylon filaments 34-2. These type of the rapping yarns are available from Tory Du-Pont Co. in Japan in the trade name of a Single Covered Yarn (S.Y C.).

The two rovings as obtained above were, under a parallel condition, by using the device as shown in FIGS. 1 to 4, subjected to a drafting operation and the two rovings were guided by the collector 16 while, between the two roving, the core yarn (high set type spandex yarn covered by the nylon filaments) was introduced from the rear side of the front rollers 12, thereby producing a cored yarn.

In this case, the drafting ratio of the roving was 16, and the drafting ratio of the core yarn 34 was 1.3. Furthermore, the twist number per meter at the spindle was 350.

As a result, a cored yarn was produced, where the high set spandex yarn as the core was twisted between anti-shrink treated wool as the outer fibers. The yarn count was 20. Furthermore, in the cored yarn, the weight ratio was 3% of the polyurethane, 7% of the nylon (cover yarn of the core) and 90% of the anti-shrink treated wool.

By using knitting machines of value of gauges of 5, 7, 10, 12 and 14, a knitting is done under rib stitch or plain and rib stitch, which allows to obtain clothes of a neatly knitted loops. Irrespective of the values of the gages, a stable value of the fabric density was obtained. Furthermore, the touch of the produced fabric was soft and an its outer appearance was excellent since the core yarns were prevented from being emerged outwardly.

It was found that a dyeing of the fabrics by using reactive dye can produce a desired finishing and any defect can not be found since the core is prevented from being exposed outwardly.

Finally, for the fabrics, a wash durability test was done under the stipulation of the Japanese Industry Standard (JIS) and any shrinkage was not generated.

What is claimed is:

1. A system for producing a cored yarn, comprising:

a drafting unit comprising front rollers and back rollers, between which a drafting zone is created for executing a drafting operation of rovings as outer fibers;

a collector arranged at the inlet of the front rollers for collecting the rovings and guiding the them to the front rollers, the collector having a width which allows the rovings to be fed to the front roller while keeping substantially separated condition;

a feeder of the filament fibers to the front rollers, the filament fibers being combined with the drafted rovings;

a guide of the filament fibers to the front roller, said guide being harmonized with the lateral movement of the rovings at the front roller in such a manner that the filament fibers is always fed to the rovings at a central position between the rovings, and;

a spindle by which the drafted rovigns are twisted and taken-up together with the filament fibers, thereby obtaining a cored yarn wherein the filament fibers as a core is covered by the twisted rovings as outer fibers.

2. A system according to claim 1, wherein, in order to obtain said harmonization, said filament guide is fixedly connected to the collector.

3. A system according to claim 2, wherein the fixed connection between the guide and collector is done by using an adhesive.

* * * * *